US007125224B2

(12) United States Patent
Raymond

(10) Patent No.: US 7,125,224 B2
(45) Date of Patent: Oct. 24, 2006

(54) ROTARY KINETIC TANGENTIAL PUMP

(75) Inventor: Charles Dow Raymond, Box 6688, Cantoka (FJ)

(73) Assignee: Charles Dow Raymond, Ba (FJ)

( * ) Notice: Subject to any disclaimer, the term of this patent is extended or adjusted under 35 U.S.C. 154(b) by 0 days.

(21) Appl. No.: 10/804,709

(22) Filed: Mar. 22, 2004

(65) Prior Publication Data

US 2004/0175268 A1 Sep. 9, 2004

(51) Int. Cl.
*F04D 29/44* (2006.01)

(52) U.S. Cl. ..... 415/203; 415/185; 415/206; 415/224

(58) Field of Classification Search ..... 415/185, 415/186, 203, 204, 205, 206, 224, 225, 902
See application file for complete search history.

(56) References Cited

U.S. PATENT DOCUMENTS 1,215,881 A 2/1917 Slemen
1,287,920 A 12/1918 Duda
2,982,224 A 5/1961 Williams
3,560,106 A 2/1971 Sablstrom
3,698,832 A * 10/1972 Price ..... 415/148
3,773,432 A * 11/1973 Chow et al. ..... 415/206
3,776,657 A * 12/1973 Ask ..... 415/225

* cited by examiner

*Primary Examiner*—Edward K. Look
*Assistant Examiner*—Dwayne J White

(57) ABSTRACT

A kinetic pump has a tangential axially inner inlet means and a tangential discharge and with a rotor having vanes forming fluid channels to move fluid from inlet to discharge. The volute is eliminated or restricted only to the discharge port sector, and the vanes, hence fluid channels, are oriented so as to be tangent to the inlet port axial cylindrical fluid entry zone. The removal of the volute makes the pump to be positive displacement, since the fluid is contained within the chambers enclosed by vanes, except for when passing the discharge port. The tangential orientation of the vanes allows the fluid, driven by atmospheric pressure to enter the chambers and fill the chambers both by the NPSH and by centrifugal force. The boundaries to the chambers are the fluid passages, and at the axial inner chamber surface by a cylindrical isobar formed by the divergent centrifugal force field, and at the axially outer surface, by an isobar corresponding to the outer distance from the axis at the tangential discharge port. This allows the pump to be filled by NPSH and gain rotational energy from the rotor, resulting in a focused tangential discharge of high velocity.

13 Claims, 9 Drawing Sheets

2
13

1
3

ROTARY KINETIC TANGENTIAL PUMP

CROSS-REFERENCE TO RELATED APPLICATIONS

Application Ser. No. 10/279,799

This invention is a continuation-in-part to my previous patent, Rotary Variable Expansible Chamber Kinetic Hybrid Pump

BACKGROUND

1. Field of Invention

This invention relates to kinetic liquid pumps as an improvement means in order to obtain greater performance, including higher head pressures at high flow rates, as well as allowing performance and efficiency in varying flow and pressure requirements with a single pump.

Traditionally, centrifugal pumps have dominated the kinetic liquid pumping field; however, the geometry of centrifugal pumps presents some problem areas, which I have endeavored to correct with this invention. The areas I am referring to are typical to centrifugal pump geometry.

2. Description of Prior Art

A typical centrifugal pump has an axial intake and a volute surrounding the rotor as a discharge. The intake always communicates with the discharge. Pumping is provided by force from vanes, which spiral outward in increasing angle with a radius from the axis of rotation. Diverging fluid channels are formed between adjacent vanes with a narrow opening at the intake side and a wide opening at the axially outer extremity. This geometry causes some problems in pumping fluids. A first problem exists at the entrance to the fluid channels due to the proximity of adjacent vanes constituting a flow restriction. By Bernoulli's Law, as the fluid is restricted, the velocity is increased, and the pressure drops. Since the pressure at this point is the lowest in the system, any further pressure drop may go below the fluid vapor pressure, causing the liquid to vaporize and cause cavitation in the pump, an undesirable state, which can cause pump damage and failure. This problem is referred to by the industry as "suction specific speed," meaning that the rotational speed of the pump is restricted by this problem. A second problem in geometry is that the vanes at this point are at an angle, which is beginning more radial and as the rotor diameter is increased becomes more tangential. This is probably because the vanes are expected to act in a similar manner to a propeller with changing pitch to continuously accelerate the fluid, in this case radially outward into the discharge volute. Having the vanes act as a radial propeller creates some problems such as contributing to the formation of vacuum on the side of the vane not acting on the fluid and further being a cause of cavitation, and on the leading face of the vane, the force of the vane on the fluid causes shear and causes the fluid to assume a rolling motion as it traverses the divergent fluid passage between vanes. This causes a rolling vortex of increasing diameter as the fluid approaches the end of the fluid passage and enters the volute. The main problem to this is that as the vortex enters the volute, the direction of motion of the outer velocity vector of the vortex is in the opposite direction to the flow in the volute toward discharge. This was verified by a computer simulation, which showed a total reversal of direction due to this effect, when micro particles simulate the liquid. This particular failure is called "re-circulation" within the industry. Another paradox is the divergent nature of the fluid passage between vanes. Because the passage is divergent, the fluid is slowing down, again due to Bernoulli's Law. But the rotor vanes are trying to speed it up. This accounts for most of the development of vortices in the passages apparently.

The apparent objective of the centrifugal geometry is to force the fluid axially outward into the volute by action of the vane fan blades. One has to then ask if this is a good objective. Pushing the fluid outward in a 360 degree manner into a volute, which then converts the radial direction of flow to a single direction, seems illogical, at least to this inventor, as it doesn't directly move the fluid flowing in the same direction, which is out the discharge duct. This geometry is similar to a light bulb, which requires various reflectors to try to collimate the light beam rather than have it already focused. It is like the difference between a light bulb and a laser.

Finally, the centrifugal pump does not appear to take advantage of the other engine, which works to drive the pump, the atmospheric pressure engine. It attempts to overcome the atmospheric engine by force, rather than by taking advantage of naturally occurring forces. I have attempted to rectify these problems seen with the prior art in as simple and as logical ways as possible, primarily by changing the vane geometry, and by making the pump positive displacement by eliminating the volute which allows the pressure to build within the fluid chamber, becoming stratified in an axial pressure gradient. And forming cylindrical isobars, which can replace solid surfaces. These isobars, which replace solid surfaces, can be used to locate extra discharge ports, which, if equipped with valves, allow the pump to change performance characteristics, simply by opening and closing of two valves. Thus, the chosen isobar determines the actual pumping chamber size, as well as pressure and flow, irrespective of the solid axial boundaries. It is interesting to note that the axially inner ports may be changed from discharge to suction, also simply opening and closing valves.

FIG. 1 shows some solutions to the previous problems. Just as in the centrifugal pump, the fluid may enter axially, where it gains rotational velocity driven by atmospheric pressure by the net positive suction head. As vanes rotate, they encounter the fluid in an intake plenum 10 tangentially, rather than at an angle to the fluid velocity, as the fluid tends to follow the rotating vacuum, created by the discharge of the rotating fluid chambers, and the fluid is moving by inertia outwardly, mostly by the NPSH, rather than by force from the leading edge of vane 7. The radial fluid speed is slowing but the rotational speed is increasing as the fluid becomes trapped inside chamber 15, which is then becomes zero velocity with respect to the rotor passages 15, and which then becomes chamber 15 which is bounded by vanes 7 and housing 1, or rather by an isobar 16 which is coincident with the cylindrical surface of housing 1, since the volute is eliminated. The cross-sectional area at 16 is larger than other cross-sectional areas in 15, so that the fluid does not increase in velocity at 16, as it does in centrifugal pumps, but is actually decreasing in radial velocity but, since the fluid is contained as positive displacement, it gains rotational velocity. Since the fluid is positively contained within chamber 15, it eliminates any relative motion between the trapped fluid within 15 and the vanes 7, such that the re-circulation problem has been dealt with. The removal of the volute, or at least the reduction in angular sector to equal only the discharge port 18, allows discharge only at 18, such that only the fluid with rotational velocity and inertial momentum is caused to exit tangentially through discharge port 18. Since the fluid velocity is the same as the rotor velocity, there is no chance for vortices to develop and to damage vane tips at 19. And while avoiding the problems described previously, the discharge velocity=vane tip velocity is at a maximum and is considerably greater than that of a centrifugal pump. This means the head pressure can be higher by the square of the difference, which is substantially higher. As previously noted, the pump rotational velocity was limited by the "suction specific speed" at 16, and with FIG. 1, there is no longer that speed restriction, and the main concern then becomes simply that the intake hose is large enough to accommodate the flow. The shape of vanes 7 and the shape of chamber 15 determines how close to a true positive displacement this pump becomes. The number of vanes 7 and chambers 15 can be significantly reduced, in fact can be reduced to one of each if desired. The mathematical analysis of the pump of FIG. 1 is simpler than that of centrifugal pumps and the results are consistent with theory. The tests show that this design is considerably more powerful than a single stage centrifugal, has much higher head pressure as well as having high flow rates.

I have included the following prior art: U.S. Pat. No. 2,982,224, which shows a kinetic positive displacement pump. U.S. Pat. No. 3,560,106 Sahlstrom 1971 which is a centrifugal pump for slurries.

U.S. Pat. No. 1,287,920 Duda which is a centrifugal pump having a tangential intake means. U.S. Pat. No. 1,215,881 Siemen 1917 which is a kinetic pump with self priming means.

SUMMARY

Although centrifugal pumps are in wide use, the geometry poses some problems, such as cavitation, as well as "recirculation". This invention is a solution to these problems and is accomplished by simple geometric changes, which radically change the operating parameters.

The first change is to make the pump positive displacement by eliminating the volute. The second change is to make the vanes intercept the intake fluid tangentially. The third change is to make the fluid not only enter the rotor chambers tangentially, but also the discharge to be a focused tangential high velocity stream. This results in having the pump filled primarily by atmospheric force by the NPSH, during which the rotor does not interact with the fluid appreciably by force of impact, but accelerates the fluid to rotor speed within enclosed chambers.

This eliminates suction specific speed requirements, and results in extending the rotational velocity limit to that of the limit of NPSH in the intake hose. This extends the pressure and power capability significantly.

This is a case where seemingly small changes in structure effect large changes in the mathematics and physics of operation and performance.

The invention is mathematically simpler than centrifugal pumps since the radial component has been eliminated from the rotor discharge, and the performance closely follows the theoretical mathematics, being positive displacement. The increase in the power of these pumps makes it useful in power transmission by momentum, as with a marine jet drive.

The use of multiple axially spaced discharge ports located on specific isobars within the pumping chamber, results in a transformable pump, which can operate either as a low pressure, high flow, or as a high pressure, low flow pump, resulting in a great improvement when used in conditions of varying head pressure requirements.

OBJECTS AND ADVANTAGES

1. It is an objective to provide a kinetic pump which is also positive displacement and which discharges the fluid tangentially at rotor tip velocity through one or more discharge ports in order to increase fluid momentum and gain higher head pressures, by creating a virtual axially inner sub-chamber boundary, which is an isobar, caused by centrifugal force. There are advantages to this method, in terms of higher momentum, higher rotational speeds, and increased power.
2. It is objective to provide a kinetic pump, which avoids cavitation by avoiding restrictions in the rotor chamber ducts and by avoiding unnecessary internal fluid velocities but maximizing and focusing the tangential discharge velocity. This is done by designing the inner rotor tips to intersect the fluid tangentially, or at an acute angle, and thus avoiding interaction with the rotor, within that zone. The advantage to this is that the fluid enters the rotor chambers primarily driven by the net positive suction head and there is little chance of cavitation. This also has the advantage of higher rotational speeds.
3. It is an objective to be able to restrict the flow rate of the pump without restricting the pressure by shaping the rotor chambers such that fluid can be metered out by a sector of the rotor chamber, much as is done in a gear pump. The advantage to this is that the pump may provide high head pressures with less power requirement, since the capacity is less.
4. It is an objective to provide a kinetic pump with fewer vanes, hence fewer chambers. This has an advantage in having less friction between the fluid and the vane surface. This has further advantages in simplicity, cost, and by being more robust.
5. It is an objective to have a pump in which the discharge velocity is the rotor tip velocity and thus the power of the pump is proportional to the cube of the rotor tip velocity. The advantage to this is that a very high power density is available in a small package.
6. It is a further objective to multiply the power of the pump by adding extra discharge ports, which may require increasing the suction cross-sectional area. The advantages of such a powerful pump are found in such uses as require both head pressure and flow, such as fire control, pressure blasting, hydraulic mining, and jet propulsion.
7. It is an objective to provide such a high power jet water propulsion system for marine use. The primary advantage to this is that the pump power is proportional to the cube of the drive rpm, which means the torque curve of the drive engine can intersect the pump torque curve at an ideal speed, and the engine will be delivering maximum torque and power, rather than minimal.
8. It is an objective to provide a kinetic pump in which the vanes are subject neither to cavitation on the inner vane tip, nor to vortices forming off the outer vane tips. The advantage to this is obvious; to prevent the pump from self-destruction.
9. It is objective to allow the pump to rotate with a pressure gradient from low on the axial inward portion to high on the axially outward portion, such that the outer periphery is a pressurized ring except as it passes the discharge port, where the pressure aids the discharge flow which is high as the pressure is released. In this way, the pump is a centrifugal force pump, whereas a centrifugal pump is primarily an inclined plane radial propeller. The advantage to this over the centrifugal pump is that there is almost no slippage at the axial outer surface, since all parts are rotating at the same pressure at any axial distance from axial center, and where the internal pressure at the axially outer zone tends to aid, rather than retard the flow.

10. It is an objective to have a pump which can have either open vanes driven by a rotor hub, vanes connected to the rotor on one side, or to have a rotor in which the chambers are enclosed on the sides. The advantage to having the vanes open to both housing walls is threefold, less friction, less potential leakage to the backside of the rotor connection, and less pressure on the shaft seal. The advantage to having the vanes attached to the rotor on one face is primarily strength and durability and ability to pass debris with some density and ability to absorb impact. The enclosed rotor chamber can be an advantage in adjusting friction and specific speed. If the chamber passage between the vanes of the rotor is large in cross-sectional area, there will be little friction, and then the part of the chamber at the rotor tips can be decreased in width and cross-sectional area. This is an advantage for pumps of large diameter but little capacity turning at high rotational speeds so as to obtain very high head pressures.
11. It is an object to be able to raise fluid pressures and flow rates by increasing fluid velocity which is rotor vane tip velocity by either raising rotational velocity or by increasing the rotor diameter. The advantage to this is to be able to reach very high head pressures, since the geometry appears unaffected by cavitation. There is a distinct advantage in reaching high head pressures without staging. Although staging is possible with this pump, it is not thought to be an advantage. It can also be an advantage to use gears or other means to each higher rotational velocity.
12. It is an objective to be able to increase or decrease the capacity by either increasing the capacity by increasing the rotational speed, the rotor diameter, the vane width, the discharge port sector, by the rotor chamber duct shape, or by the rotor vane angle. The advantage to this is versatility of use.
13. It is an object of the invention that high head pressures may be attained without either staging or supercharging in most cases. Both staging and supercharging involve more machinery. This device is simple and higher pressure and flow rates may be accomplished simply by increasing the intake hose and port size or number.
14. It is an object to provide a fluid motor in which the high pressure fluid enters the motor tangentially axially nearer the axis of rotation and is slowed by interaction with the vane surfaces, delivering torque to the rotor, and being discharged with a high velocity with respect to the vane surfaces but little velocity with respect to the earth.
15. It is an object to provide a pump, which can pump slurries, sludge's, liquids containing solids as well as viscous mixtures. It is an object to provide multiple intake ports in the pump for the handling of slurries and sludge, which allows the water and the mixture to be regulated by having valves to adjust the water intake supply. This has an advantage in the simplicity of operation better suction and the regulation of the slurry consistency.
16. It is an object to provide a versatile pump, which has multiple functions, based upon ports being placed at different pressure isobars within the pressure gradient inside the fluid passages between vanes. This has two distinct functional advantages; (a) that contaminants may be removed from the fluid centrifugal force, separating clean fluid from contaminated fluid; (b) that when the different isobaric ports are provided with valves, the user may choose a port location, which suits the pumping requirement, hence enjoy greater pumping efficiency. Since kinetic pumps, such as centrifugal pumps, have fixed geometry relating to specific pressure vs, flow curve; they are only efficient over a relatively small portion of the curve. This presents a problem since pressure requirements vary widely. Thus it is of great advantage to be able to shift gears, so to speak, from an efficient high pressure, low flow pump, to an efficient low-pressure high flow pump at will.
17. It is on object to provide a kinetic pump with can simultaneously pump a fluid and separate out fluids or solids of different density. This can be of great advantage to a fuel pump, where the pumped fluid through one discharge port is clean and impurities such as water and rust pass through another discharge at a different pressure.
18. It is an object to provide a pump, which has the multiple capabilities of providing motive thrust to a vehicle, while at the same time pumping a selected density material into said vehicle, and discarding the less dense material with the pumped fluid, such as in a gold dredge. This can have a number of advantages when dredging the sea floor having sand with flour gold. The sand is not taken on board for processing and only the concentrate is pumped aboard a barge. The barge is anchored to swivel and the vehicle is tethered, and travels in circles about the barge powered by the jet action of the pump. By adjusting the tether radius every revolution, a large circular area may be accurately covered with minimal effort.

IN THE DRAWINGS

Figure 8A:
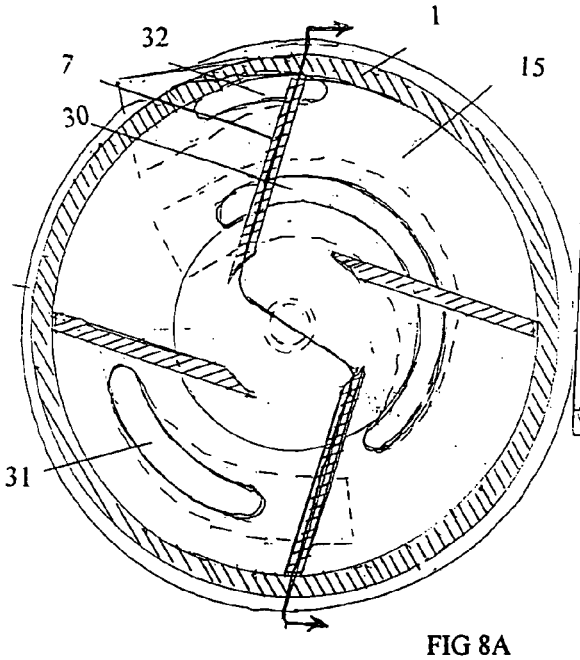
FIG. 8A is a second preferred embodiment, and shows a multiple purpose kinetic pump having multiple discharge ports spaced at varying axial distances from the axis of rotation.
Figure 8B:
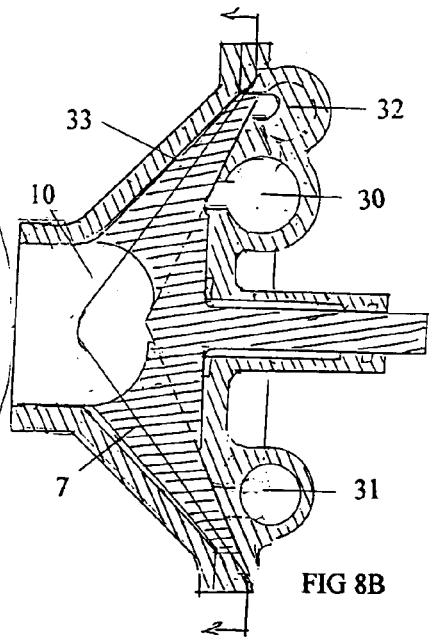
FIG. 8B is a side view of FIG. 8A.
Figure 8C:
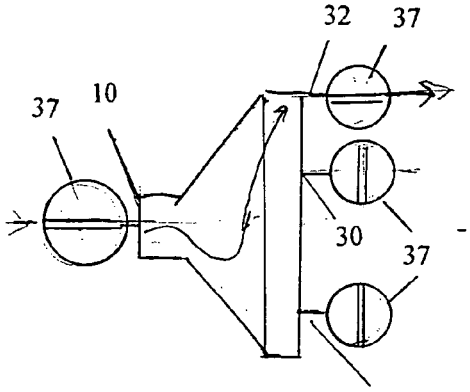
FIG. 8C is a side schematic view of the pump of FIG. 8A and FIG. 8B with valves attached to the porting ducts with the only discharge valve 32 open for high pressure low flow.
Figure 8D:
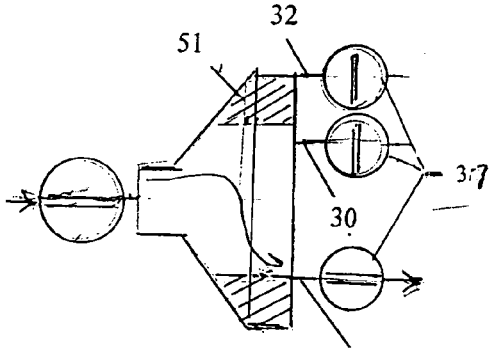
FIG. 8D is a side schematic view like FIG. 8C except showing only discharge valve 31 open for moderate flow moderate pressure.
Figure 8E:
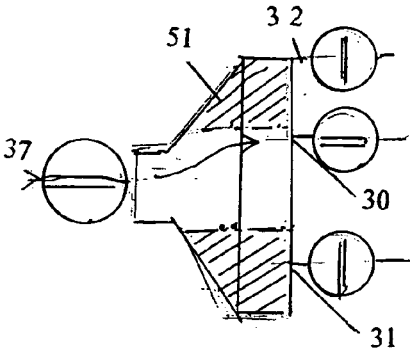
FIG. 8E is a side schematic view as FIG. 8C except only discharge valve 30 is open for low pressure and high flow.
Figure 8F:
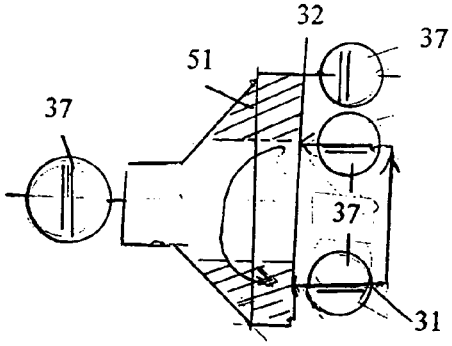

FIG. 8F is a side schematic view similar to FIG. 8C in which the intake valve is closed and both the discharge valves 30 and 31 are open and showing the pump is pumping in a loop with discharge valve 30 having changed to intake valve 30.

Figure 8G:
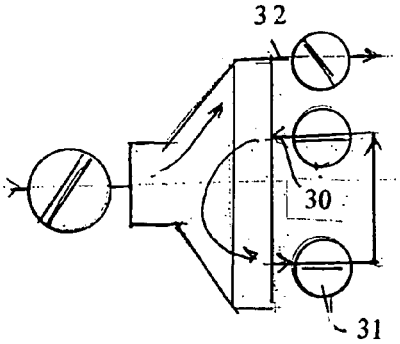

FIG. 8G is a side schematic view similar to FIG. 8C in which the pump is pumping in a loop and valves on the intake and pressure discharge are being cracked open for priming.

Figure 8H:
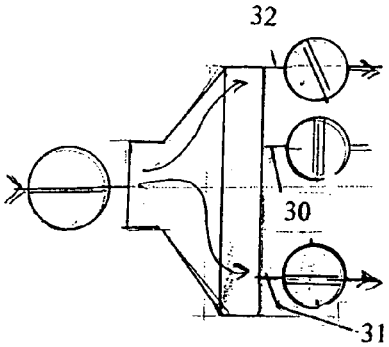

FIG. 8H is a side view of a pump as shown in FIG. 8C with two discharge ports open, but the higher pressure discharge only cracked open for separation of density in the fluid.

Figures 1, 2:
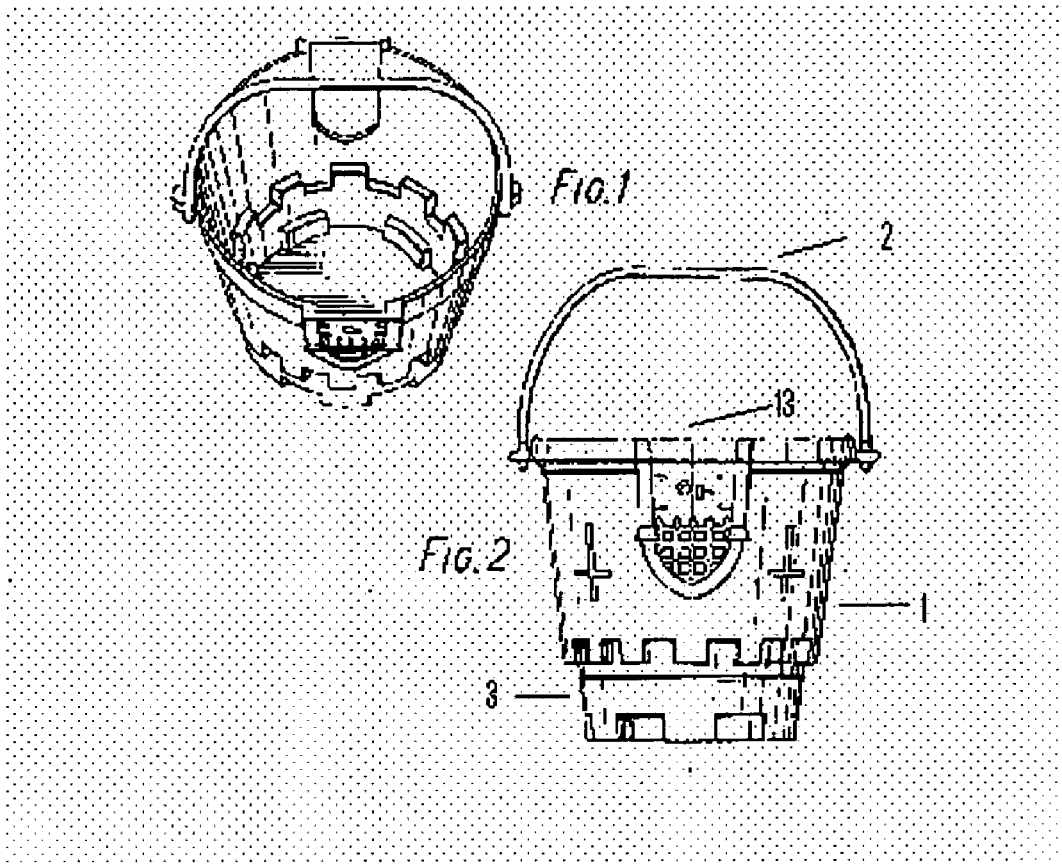
FIG. 1A is a front sectional view of a preferred embodiment.
FIG. 1B is a sectional side view of FIG. 1A and is also typical of side views of FIG. 2A, FIG. 3A, and FIG. 4A in basic structure.
FIG. 1C is a front view of an alternate intake for FIG. 1A, 2A, 3A, or 4A.
FIG. 1D is a side view of FIG. 1C
FIG. 2A is a front sectional view of a pump similar to FIG. 1A except having two discharge ports.
FIG. 2B is an alternate rotor for FIG. 1A, 2A, 3A, or 4A.
FIG. 2C is a side view of FIG. 2B.
Figure 1A:
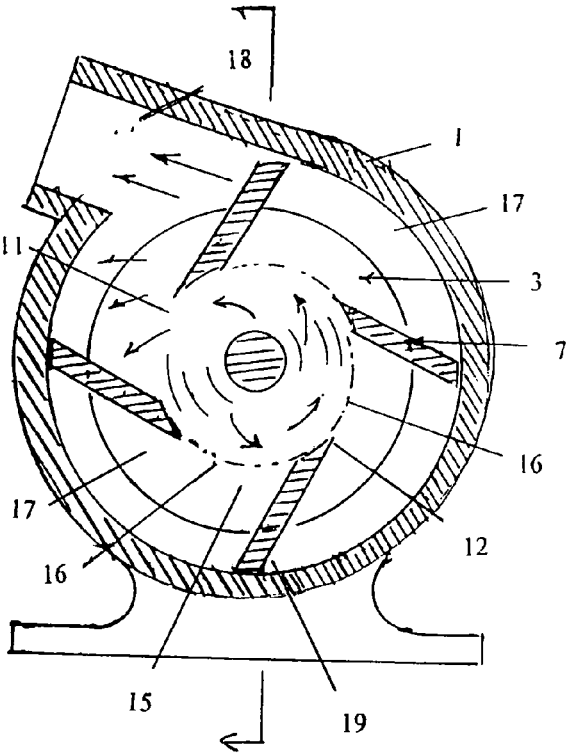
Figure 9A:
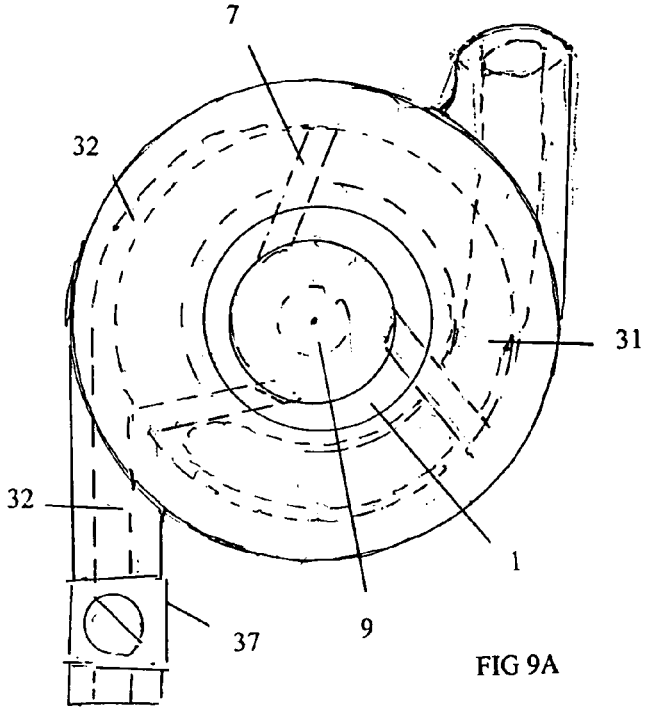

FIG. 9A is a front view of a pump as in FIG. 1A, expect having two discharge ports operating in a similar manner to FIG. 8H.

Figure 9B:
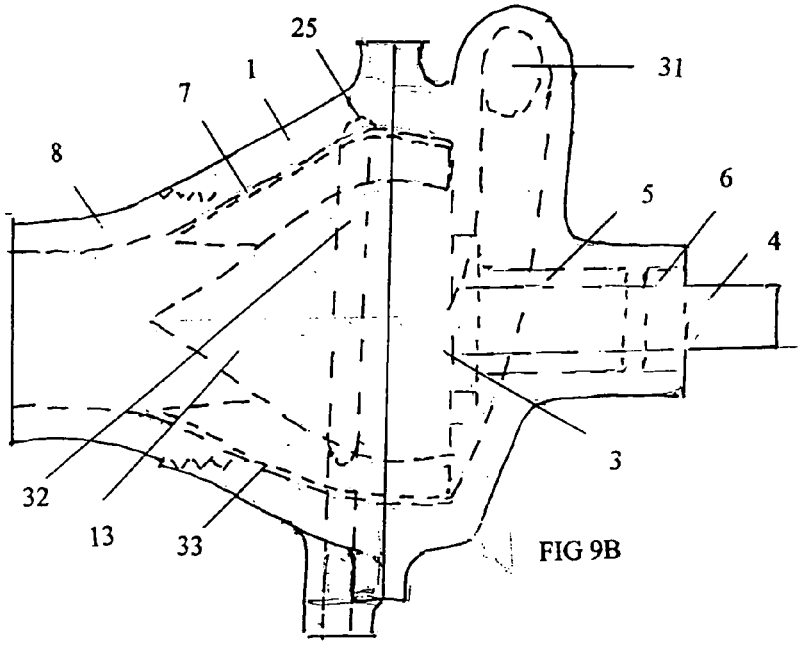

FIG. 9B is a side view of FIG. 9A.

Figure 5A:
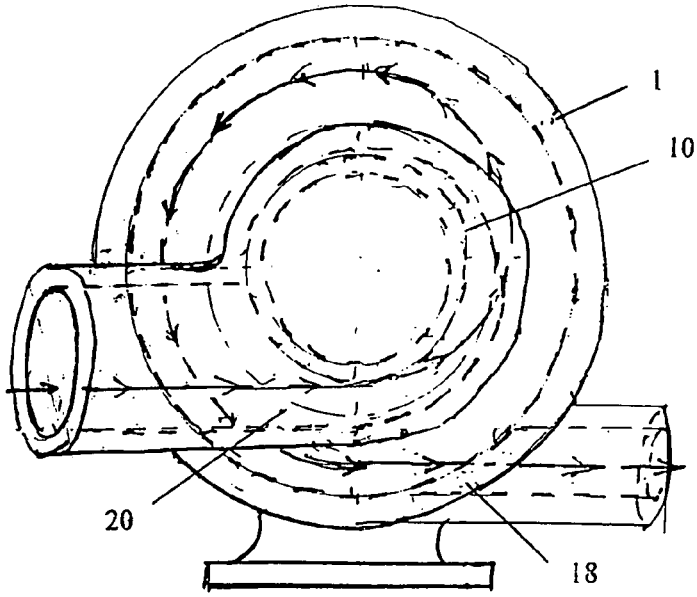
FIG. 5A is a front view of a pump with vane structure which may be similar to 1A, 2A, 3A, and has a different intake structure.
Figure 5B:
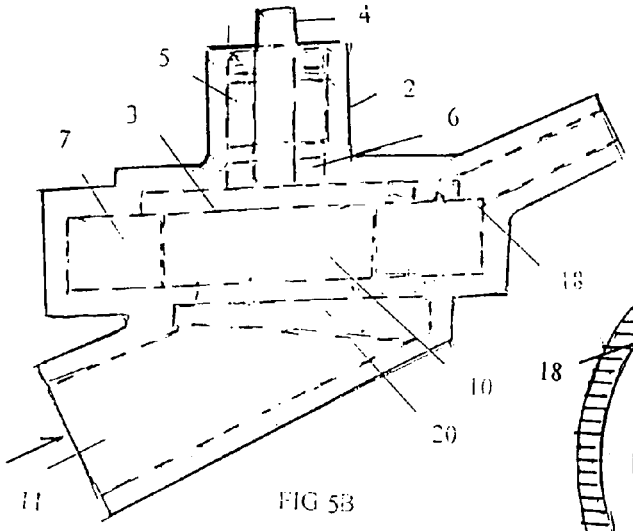
FIG. 5B is a plan view of FIG. 5A
Figure 9C:
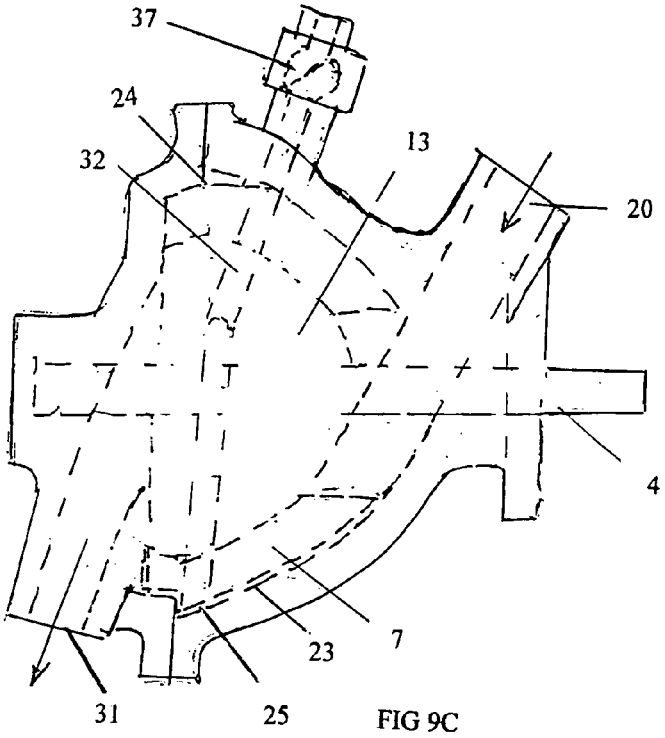

FIG. 9C is a side view of a similar pump to 9B except that the pump intake is similar to FIGS. 5A and 5B.

Figure 10:
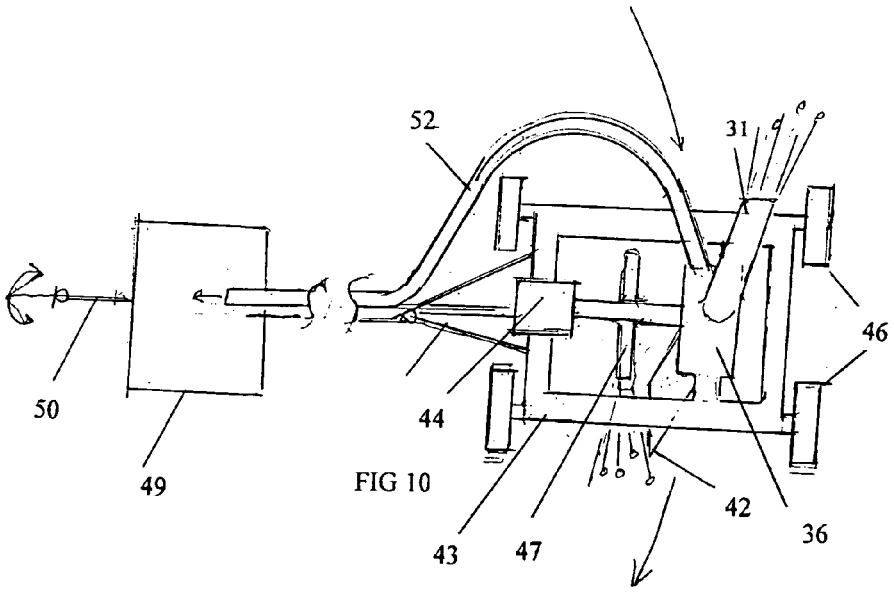

FIG. 10 shows a schematic plan view of a pump as in FIG. 9C being used for two purposes, the first being to separate dense solids from a fluid containing solid particles; and the second being to propel a carriage on which the pump is mounted. FIG. 10 shows the pump operating as a gold dredge as an illustration of the principles.

In the figures parts are, indicated by the following numbers:

1. Housing member with chamber, port.
2. Housing member with rotor, shaft.
3. Rotor.
4. Shaft.
5. Bearing.
6. Seal.
7. Vane.
8. Intake fitting.
9. Intake.
10. Intake plenum.
11. Opening at axial inner vane tip cylinder of revolution or outer boundary of intake plenum.
12. Vane angle to 11.
13. Rotor cone.
14. Radial vanes on rotor cone.
15. Fluid channel between vanes.
16. Isobar.
17. Enclosed chamber.
18. Tangential discharge.
19. Angle of vane with cylindrical axially outer surface of housing element chamber.
20. Tangential intake.
21. Vane shape for motor.
22. Spiral vanes on intake fitting.
23. Path of dense particles.
24. Isobar.
25. Axially high pressure limit.
26. Axially outer port.
27. Secondary intake ducts.
28. Flange.
30. Axially inner tangential discharge port.
31. Axially intermediate tangential discharge port.
32. Axially outer tangential discharge port.
33. Bow of boat.
34. Bottom of boat.
35. Intake through bottom of boat.
36. Pump.
37. Valve.
38. Engine.
39. Outboard engine.
40. Handle
41. Stern of boat.
42. Suction duct
43. Carriage frame
44. Hydraulic motor driven with line from barge.
45. Sea floor.
46. Wheels on carriage.
47. Rotating agitation bar attached to shaft 4.
48. Setting tank with filter.
49. Barge.
50. Anchor to seafloor.
51. Rotation fluid flywheel shown by crosshatch.
52. Hose to barge from port 26.
53. Tether between barge and carriage.

Operation of the Pump

Figure 1C:
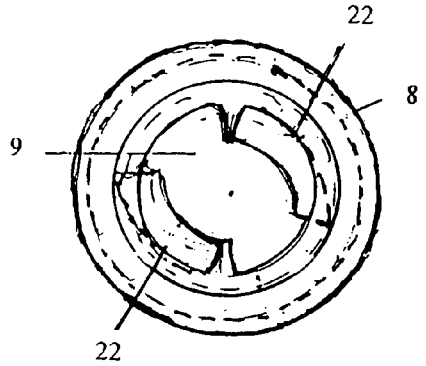
Figure 1D:
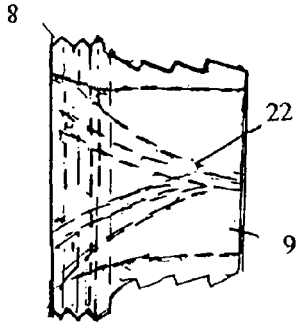
Figure 1B:
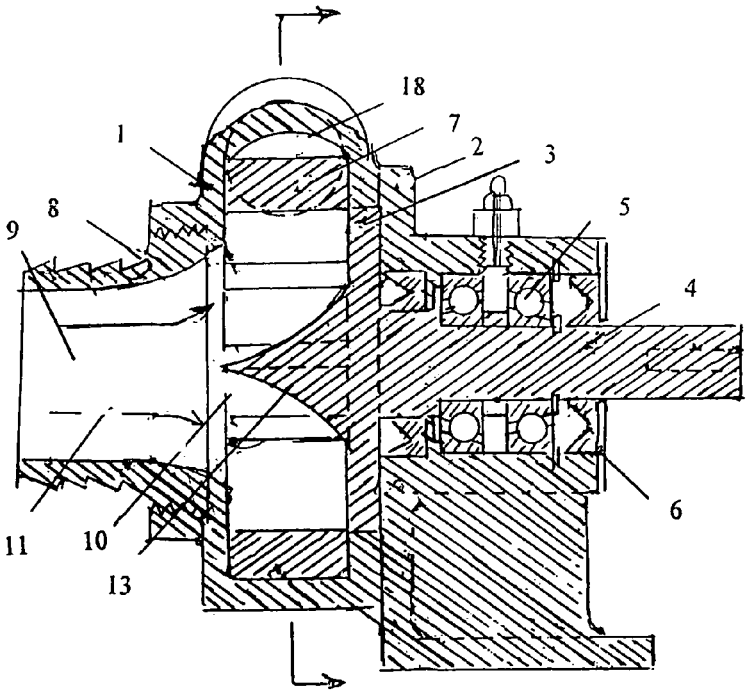

In FIG. 1B, arrows show fluid being drawn in through intake fitting 8 in housing member 1 into intake plenum zone 10, whereupon the fluid is forced radially outward by the diverging shape of the intake plenum 10 caused by rotor cone 13 and housing member 1. At this point, one would expect the flow to be converted from axial to radial, except that the motion of vanes 7, shown in FIG. 1A, is circular, and the passing of the vane 7 in the cylinder of revolution described by the radially inner vane 7 tips as a boundary 11 to plenum 10, creates a whirlpool effect, causing the flow direction to change from radially outward to more of a tangential direction with respect to the cylinder of revolution boundary of the intake plenum 10 caused by the vane 7 motion. This tangential direction may be enhanced by spiral vane guides 22 on intake fitting 8 shown in FIG. 1C and FIG. 1D, such that the intake flow is given a spiral, hence tangential component, driven by atmospheric pressure in the form of net positive suction head. Alternately, the tangential intake flow may be aided by radial vanes 14 on rotor cone 13 as shown in FIG. 2B. However, it is more efficient to let atmospheric pressure be the engine driving the fluid toward a tangential intake into the channels between vans 15, than using the driven energy from the rotor.

Having achieved a fluid direction that is largely tangential, i.e. in the same rotary direction that the vanes are traveling, the fluid proceeds through the opening between vanes 7 at 11, the outer cylindrical boundary of the intake plenum 10. It is important to note that at this entry into the fluid channels 15, between vanes 7, the vane tip 12 is tangential to 11 and so the fluid is moving in approximately the same direction as the vane tip 12. This necessarily means that not only is the direction the same, but that the velocity difference at 11 is much less than normally seen in centrifugal and other kinetic pumps. This means that the fluid enters at a velocity magnitude which is proportional to that of the net positive suction head, while the vane tip 11 velocity is the that of the vane tip at that rotor diameter caused by the rotor rotational velocity since the velocity vectors are in approximately the same direction, there is a relative velocity of tangential rotor velocity at the inner tip 12 minus the fluid velocity caused by atmospheric pressure, the NPSH. Then while the rotor is tending to intersect the tangential intake flow, it does so at a very acute angle, and beginning at NPSH velocity, crosses the boundary of the intake plenum at 11 and continues tangentially toward the outer chamber wall of housing element 1 and thus fills the space between the adjacent vanes 7, the axially outer chamber wall, and the axially inner boundary 11. It is important that the fluid is allowed to fill the chambers almost totally by force of the atmospheric engine which creates the NPSH, and not by being forced by reaction against the vanes, which can create turbulent flow, or at least cause a rolling vortex in the fluid traveling toward the outer chamber wall, which in a centrifugal 1 pump is a volute. It is also important to note that in this pump, the opening at the entrance to the channel between the vanes 15 is the distance 11, which is larger than any successive distance within the channel 15 and hence the entrance to the channel 15 is not a restriction which would cause an increase of velocity and a drop in pressure, from Bernoulli's Law, which can result in pressure of the fluid and creating cavitation. Thus cavitation is avoided by this geometry.

Then as the chambers are filled primarily by the momentum of the fluid, and since the angle on the vanes 7 increases from tangential at the fluid entrance to channel 15 to more radial at the radially outer vanes position at 19, the vanes have little direct contact with the fluid since although the vane is traveling faster than the fluid, it is also angled back starting at zero angle and increasing to about 60 degrees in FIG. 1A. As the fluid enters the channels 15, it begins to gain further rotational energy from containment by the vanes 7, and at the same time the fluid loses all radial velocity, unlike with centrifugal pumps.

As the fluid loses all the radial velocity and is captured by the vanes 7 and the housing 1 chamber wall, it is also captured on the radially inner surface by an isobar 16 shown by a phantom line. It is captured by the divergent force field of centrifugal force, much as a full bucket of water is contained by the convergent force field of the earth's gravity. Since the fluid is totally contained by the chamber 17 it is at rest with respect to the rotor and only has rotational velocity. As such, the pump becomes positive displacement by definition, since the fluid is contained, then displaced. This is quite similar to the displacement in an external gear pump, which is not acting against a pressure head. The contained fluid is then carried by the rotor around the cylindrical chamber wall in housing element 1 to where it is ejected by its own momentum through tangential discharge 18. Unlike centrifugal pumps, the fluid, which, is contained in the enclosed chambers 17, develops a pressure gradient due to centrifugal force, which is low at the radially inner portion of chamber 15 but high near the radially outer cylindrical wall of the chamber of housing element 1. As the enclosed chamber passes the rotary valve tangential discharge port 18, the pressure is relieved and converted into velocity. Just prior to crossing the tangential discharge port, the fluid has rotational momentum, but also, being in an enclosed rotating chamber, it has pressure due to centrifugal force. The fluid, which is contained, is at rest with respect to the rotor. But as the chamber begins to pass the port 18, it begins to lose pressure, and to gain velocity. The chamber resembles a tank with a spigot at the bottom, which is opened and a stream with velocity comes from the spigot. Then if the tank is traveling at rotor velocity, and the spigot is aimed toward the direction of motion, the velocity of the fluid will be the rotor velocity plus the spigot velocity, resulting in a very high tangential discharge velocity.

Thus, in FIG. 1A, fluid enters axially but is turned to a tangential direction largely by the shaping of the flow by vacuum, fills fluid passages 15, so that fluid enters the actual pumping zone, which is bounded by vanes, largely by the atmospheric engine, whereupon the fluid is contained positively and gains rotational energy, and is then discharged tangentially. Because the discharge velocity is at the rotor tip velocity due to the containment manner, the discharge momentum is high, much higher than with a centrifugal pump having the same rotor diameter. This results in greater head pressures, since head pressure is proportional to the square of the exit velocity. The drive system, shaft, bearings and seals are shown in FIG. 1B and are typical to other figures as well.

Figure 2A:
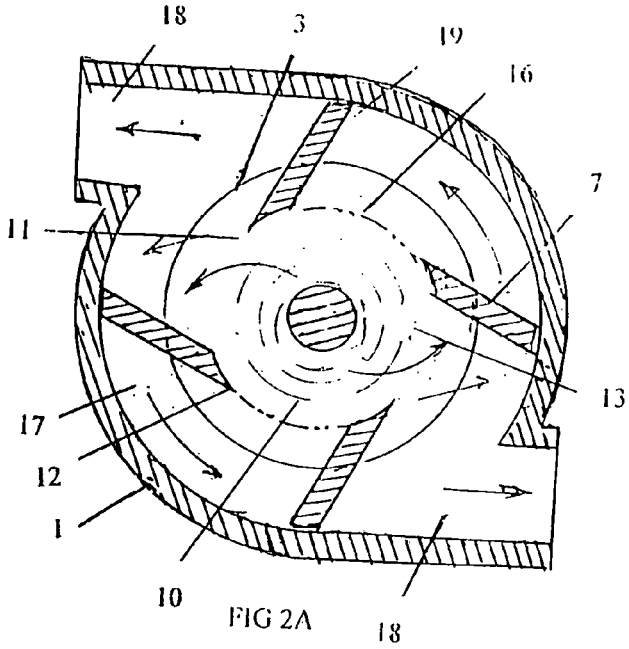
Figure 2B:
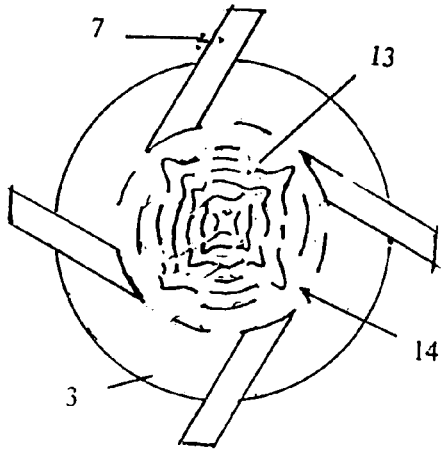
Figure 2C:
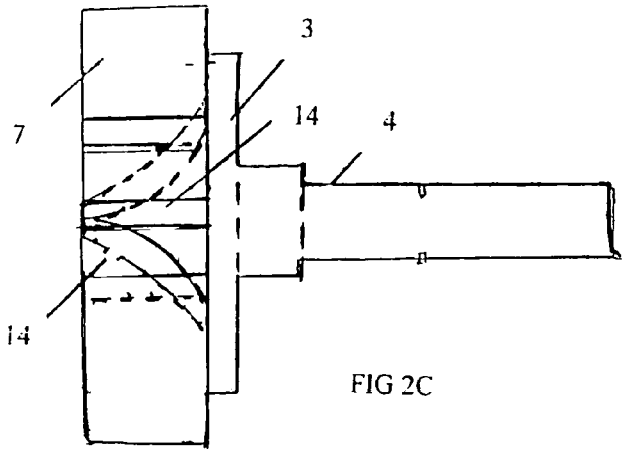

FIG. 2A shows the same basic pump as in FIG. 1A, but with two discharge ports 18. Just as in FIG. 1A, fluid is contained in chambers 17, bounded by the adjacent vanes 7 and the cylindrical chamber wall of housing member 1 and by the isobar 16. Provided the intake 9 is large enough to accommodate the flow, this pump will have twice the capacity of the pump of FIG. 1A, provided the vane depth is the same, but it will have the same exit velocity, hence the same pressure capability. Having twice the capacity and the same pressure means it will require twice the drive power. This pump is useful for high power applications such as firefighting. The alternate rotor design shown in FIGS. 2B and 2C has small radial vanes to aid in the creation of a whirlpool effect and tangential intake to the fluid channel entrance 16. The side view is similar to FIG. 1B.

Figure 3A:
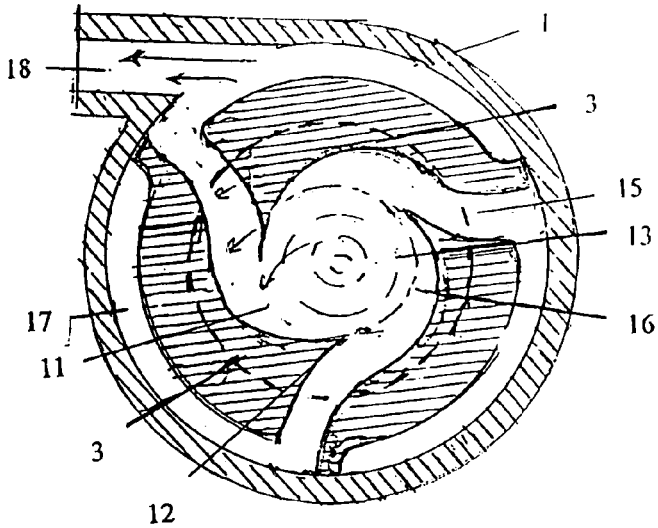
FIG. 3A is a sectional front view of a pump similar to FIG. 1A but having different vane and fluid passage configuration.

FIG. 3A is similar to FIG. 1A except for the vanes 7 shape the fluid channel 15, and the shape of the enclosed chamber 17 when bounded by isobars. In FIG. 3A, the fluid is drawn into the channels 15, which end being the enclosed chambers 17. In this case, the enclosed chamber 17 has a portion on the periphery next to the cylindrical chamber wall of housing element 1. This means the fluid, which is contained in the peripheral part of chamber 17, is at the maximum energy state, being at the maximum rotor speed, which is at vane tip at 19. All the fluid that is contained in the enclosed peripheral chamber 17 will discharge tangentially by momentum through tangential discharge port 18, but none of the other fluid, or at least very little, located in channel 15 will be discharged, but will fill the part of chamber 17 which has already been discharged. In this way, the contained fluid is metered out much as other positive displacement pumps and the capacity can be calculated as being proportional to the volume of the peripheral containment times the rotational velocity, i.e., the cubic inch displacement volume×the rpm divided by 231 cubic inches per gallon gives gallons per minute. This allows one to accurately prescribe the pump capacity. It is a primary objective to not only prescribe the capacity, but to be able to reduce the capacity while maintaining the fluid velocity so as to gain head pressure without excess capacity, hence excess power requirement. The geometry of FIG. 3A allows continuous discharge except of the small interruption at each vane tip. Shown are 3 vanes 7 and 3 channels 15 as well as 3 enclosed volumes 17. This number can be increased or can be decreased to as few as one. The number of vanes in FIG. 1A can be as few as two but in FIG. 2A, four vanes are required in order to enclose the chamber 17.

Having the capacity easily regulated as in FIG. 3A, allows the output flow to be decreased as much as desired by simply making the chambers 17 small in cross-section. This allows either an increase in rotor diameter, or an increase in rotation speed, either of which will result in increased fluid velocity and head pressure and with a corresponding decrease in capacity so that the drive power remains constant. This allows very high head pressure without staging. The side view of FIG. 3A is similar to FIG. 1B.

Figure 4A:
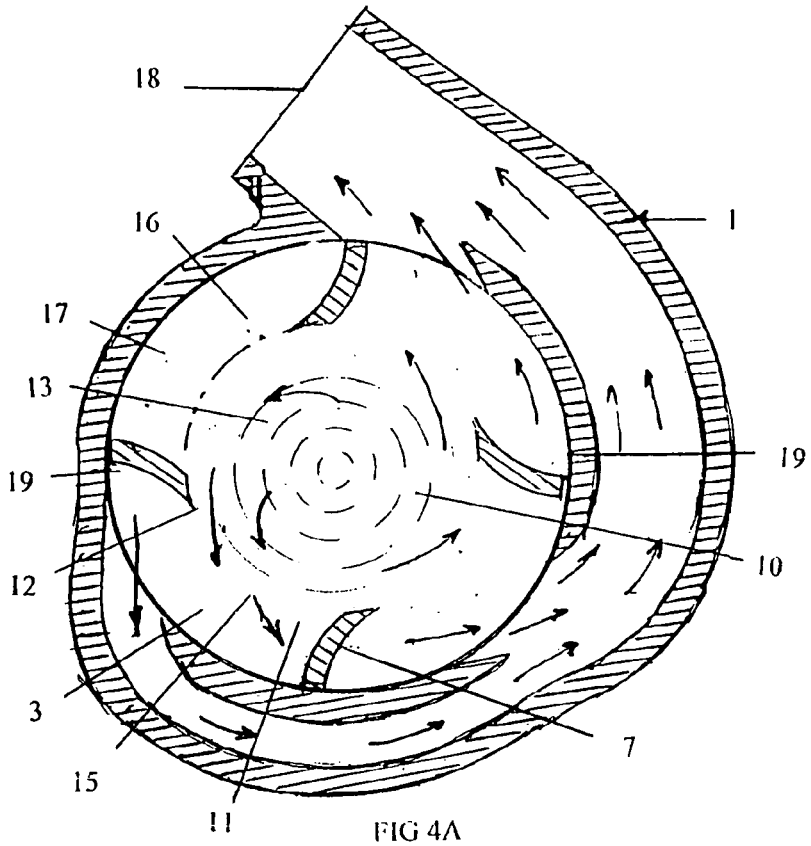
FIG. 4A is a front sectional view of a pump similar to that in FIG. 1A except for a slightly different vane shape and that it has three discharge ports into a common staged discharge.

FIG. 4A is another front view with vanes 7 which are tangent at 11, but curved and more perpendicular to the cylindrical inner chamber surface of housing member 1 at 19. The operation of the embodiment is similar to that of both FIG. 1A and FIG. 2A except that FIG. 4A has 3 tangential discharge ports feeding into discharge. The discharge 18 has 3 feeder ports through housing member 1 such that there is always a momentary capture of the fluid 17 where boundary isobar 16 exists. This is true for each of the three sectors between discharge ports such that the length of each sector is no longer than the distance between vane tips, as there are four vanes 7 but only 3 discharge ports. The final discharge is the sum of the 3 flows and gives the discharge a stepped volute shape. Because the fluid is trapped prior to discharge and reaches rotor velocity, the pressure will be similar to that of the pump in FIG. 1, but the capacity will be greater. The arrows shown in FIG. 4A are meant to show the flow direction of the fluid through the pump. The side view is similar to FIG. 1B.

FIG. 5A is a front view of a pump which may have a vane configuration similar to that in either FIG. 1A, FIG. 3A or FIG. 4A but shows a different means of achieving the tangential intake flow. The fluid in FIG. 5A enters tangentially from the side rather than axially as in FIG. 1*a*, 2A, 3A and 4A. The intake plenum 10 has an intake volute, which forces the fluid into a circular motion such that it leaves the intake plenum 10 tangentially and from that point on is similar to the flow in FIG. 1A, FIG. 2A, FIG. 3A, FIG. 4A as it becomes captured in enclosed chambers, reaches rotor rotational velocity and is discharged through tangential discharge 18. The arrow shown in FIG. 5A, shows the path of the fluid through the pump.

FIG. 5B shows a plan view where the fluid enters at 11, tangentially is guided by a volute at 20 so as to enter intake plenum 10 tangentially where it is again captured in an enclosed volume, reaches rotor rotational velocity, and is the discharged at 18. The discharge shown in this view is a variation and shows it may be discharged tangentially, but out the side with a small axial component.

Figure 5D:
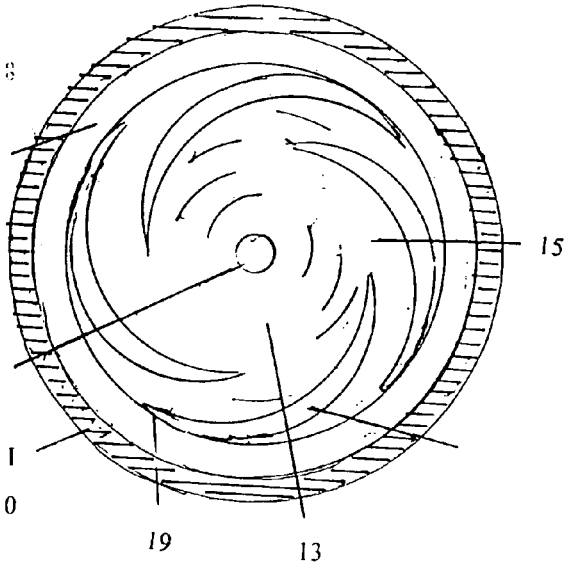
FIG. 5D shows a rotor and vane shape design that can be used in FIG. 5D, FIG. 6A or 6B as a motor.
Figure 5C:
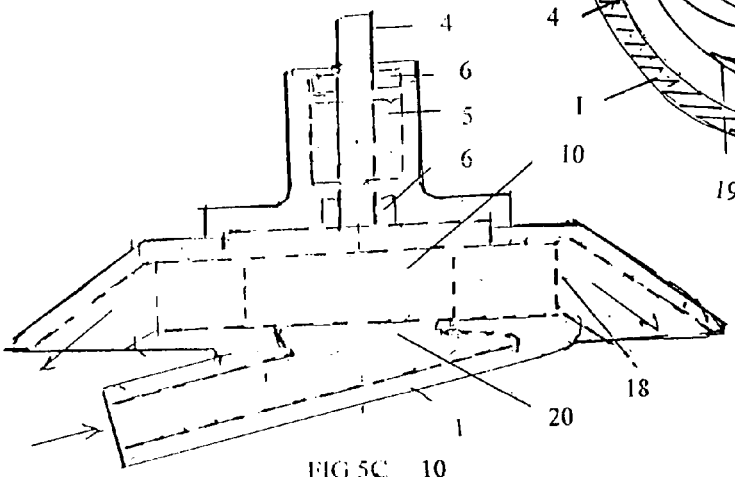
FIG. 5C is a plan view of a motor similar to FIG. 5A, but with a different discharge.

FIG. 5C shows the same plan view of the pump, but shows it as a motor, the fluid enters the pump in the same manner as in 5B, except the entering fluid is high pressure fluid having high velocity. Again, the fluid is acted on by a volute to send it into a circular whirlpool at 20 into intake plenum 10 tangentially, but at high velocity, where it enters the passage between vanes. Multiple tangential intake ducts may be used to advantage. However, as a motor, the vane shape should be similar to the shape 21 shown in FIG. 5E. Note that as a motor, the vane configuration is more resembling that of a centrifugal pump. The fluid enters the passage channels 15 at an angle, which is not exactly tangential, but leaves the pump housing member 1 tangentially. With the motor vanes 19, the fluid is leaving the intake plenum 10 tangentially but at the stopped rotor position sees the channel passage 15 as at head pressure. But as the rotor begins to turn by tangential jet action, the apparent angle between the intake flow and the vane begins to change from initially a reverse direction acute angle, toward a 90-degree angle. While this is happening, the rotor is increasing in speed and the pressure is changing to velocity and as the rotor reaches speed the fluid at intake plenum 10 is at lower pressure, but high rotational velocity. As the fluid leaves intake plenum tangentially, it acts against the motor vanes 19 such as to cause the rotor to rotate and provide torque. The momentum of the fluid is, slowed by vanes 19, both in the radially outward direction and tangentially, such that it may leave the rotor into discharge port 18 tangentially with a high velocity with respect to the vane tips, but with little or no ground speed. In this way it is acting in a similar manner to the propeller type hydro turbines where the fluid acts directly against a blade. While the propeller is working in an axial direction, this device works in both a radial and tangential direction. The discharge, although tangential, can also be 360 degrees as shown in FIG. 5D, which means that as a motor, the fluid is not captured as it was in the previous pump embodiments, but the fluid is always in continual motion with respect to the rotor and the channel 15 between vanes and there is no captured volume 17. At start up, with the rotor at zero velocity, pressure forms in the intake plenum 10 and the fluid has to be ejected through the fluid passages 15 which provides, torque by thrust exerted on the rotor. At this point of operation, the torque is quite high, but the power is low due to no rotational speed. As the rotor gains rotational velocity, the manner in which the torque is generated changes from jet reaction to force against a rotor member and in this way is similar to both the Pelton wheel and the axial propeller motor. The difference between this and a Pelton wheel is that this concept allows a high flow rate as well as a high specific speed. The rotor speed, which is a result of velocity from the head pressure of V squared=2 gH is quite high since the fluid is entering nearer to the axis of rotation. This means the fluid velocity with in the channel passages 15 is high with respect to the rotor, but the fluid velocity with respect to the earth is slowed to near zero by the vanes, this slowing causing torque to the rotor. This is in some ways opposite to a Francis reaction turbine, where the fluid enters the rotor channels as tangentially as possible and is discharged axially, the torque being provided by the change in angular momentum from high momentum to low momentum.

However, the result is the same, the momentum of the fluid is decreased resulting in torque and work being done by the motor. The rotational speed the rotor may attain is largely a function of the pitch of vanes 19. If the trajectory of the pressure fluid is tangential, it must totally reverse its direction and leave the channels 15 tangentially in the opposite direction. However, the fluid is inertial and tends to proceed tangentially in the direction it left from intake plenum 10 traveling only a short distance in which it loses its momentum. But to achieve that, the rotor vanes 19, as shown in FIG. 5*d* must travel 90 degrees indicating that the rotor tip velocity is considerably greater than the fluid head velocity, which is unusual in the art. The means the specific speed is expected to be high. Thus in FIG. 5A, FIG. 5B the fluid enters tangentially into the rotor pumping channels where it gains rotational energy by moving to a larger diameter and higher velocity and leaves the pump tangentially. It enters tangentially, is accelerated to a higher velocity by the rotor channels 15 and enclosed chamber and leaves tangentially in the same rotational direction. As a motor, the fluid enters tangentially, is slowed in the channels between vanes 15 and is also discharged tangentially but in the opposite direction.

Figure 5E:
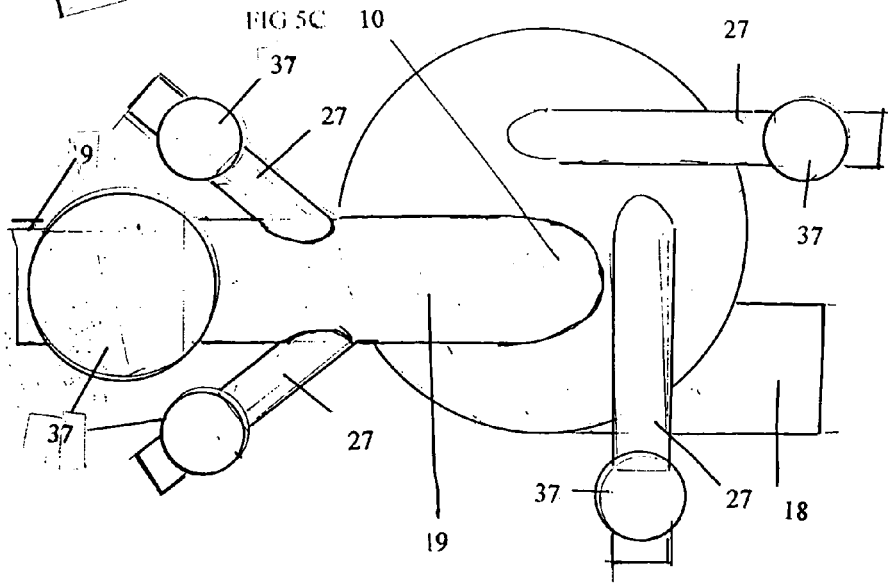
FIG. 5E shows a front schematic view of the pump of FIG. 5A and FIG. 5B for pumping slurries and sludges.

FIG. 5E is a front view of a pump shown in FIG. 5A used as a slurry or sludge pump. FIG. 5E shows a large intake duct 9 with a valves 37 through which the slurry is drawn into the pump. There are also secondary intake ducts 27 which communicate both with the intake duct 9 and with the intake plenum 10 which have valves 27 and can be connected to a water source. In order to start the pump, the main intake valves 37 is closed and the secondary water valves 27 are opened, and the pump is primed and started pumping water. Then the main intake valve is opened and the secondary water valves are partially closed. The water is pumped and a strong vacuum is formed at 9, causing the slurry to be accelerated toward the intake plenum 10. The slurry continues by inertia into intake plenum 10 and on to be intercepted by vanes 7 which intercept the incoming slurry at an acute angle and captures the slurry in fluid passages 15 as typically shown in FIG. 1A and FIG. 1B. Because the slurry has a higher density than water, it is thrown out of tangential discharge port 18 at a higher momentum than would normally be seen with centrifugal pumps and this results in a lower pressure or greater vacuum seen in intake plenum 10 which facilitates the pumping due to a higher pressure difference within the pump. Valves 27 can regulate the slurry flow and consistency.

Figure 6A:
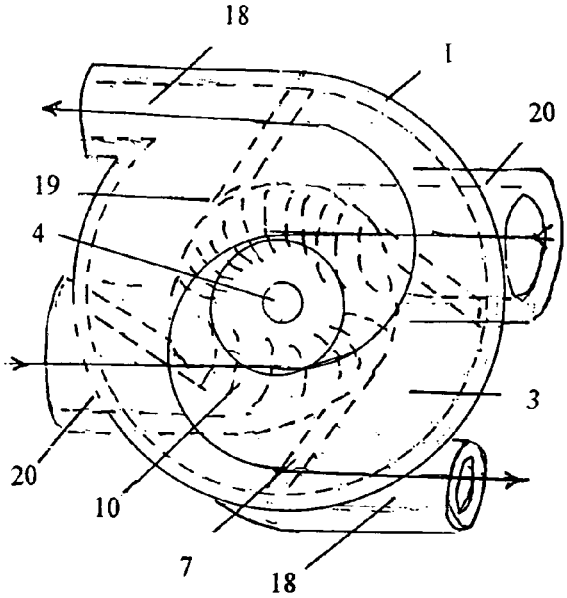
FIG. 6A is a front view of a pump similar to FIG. 1A, but having two different intake ports and two discharge ports.

FIG. 6A shows a front view of a double intake, double discharge version of FIG. 5A. Fluid enters tangentially through the side at 20 into intake plenum 10. Guided by half circle volutes such that a whirlpool exists in intake plenum 10 and it is drawn in the channels between vanes 15 where it is contained, gains rotor velocity and momentum and is discharged through tangential discharge ports 18.

Figure 6B:
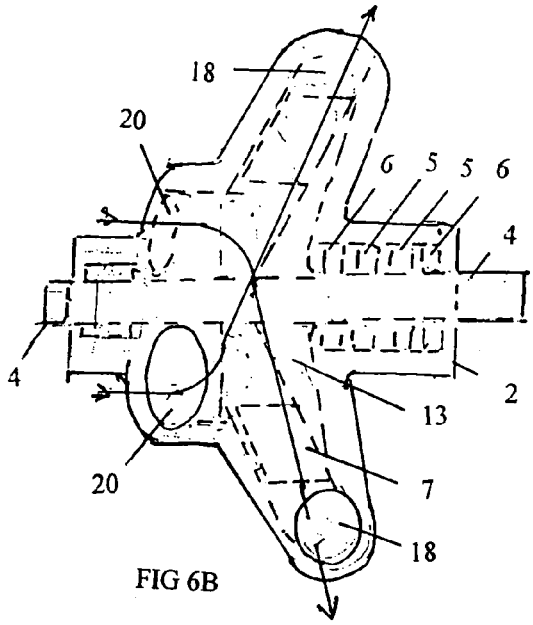
FIG. 6B is a side view of FIG. 6A.

FIG. 6B is a side view showing many of the same parts with the same functions as previously discussed. The arrows show the path of the fluid through the pump. This is a very high power device, suitable for liquid jet propulsion. If this pump is positioned in a boat such that there are intake ducts through the bottom of the vessel with the ducts going aft into the pump intakes 20 and the discharge ducts 18 turned to exit aft of the vessel, thrust will be obtained. An advantage of this type of marine drive is that the fluid momentum increases as the cube of the rpm and experiment shows it may be more than the cube. This is of considerable advantage to a high speed, planing vessel, since the vessel engine at high rpm will be delivering high power to the fluid, due to the exponential relationship of the rpm vs. torque curve. In an axial turbine, the torque is linear, and due to the intake speed, very little power is delivered to the fluid even through the engine is racing. In this design, full power can be delivered. FIG. 6A can also be a motor, provided the intake ducts are smaller compared to discharge, and if the FIG. 5D type rotor is used.

Figure 7A:
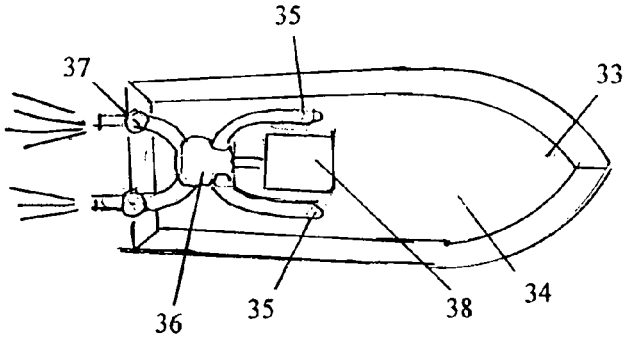
FIG. 7A shows a plan schematic view of a pump such as in FIG. 6A and FIG. 6B used as a jet propulsion drive for a boat.

FIG. 7A shows the pump as in FIG. 6A and FIG. 6B in a plan view of a boat 33. The pump is mounted fixed to the stem area of the boat at 36 being driven by engine 38. Intake ducts 35 come through the bottom of the boat 34 into the pump and discharge ducts 18 provide thrust to the boat. Valves 37 on the discharge may be used to steer the vessel. Discharge ducts may be turned to reverse the boat.

Figure 7B:
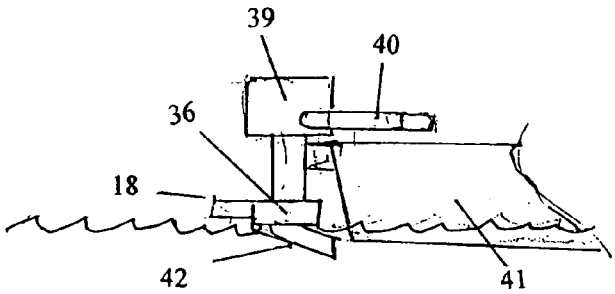
FIG. 7B shows a side schematic view of a pump such as in FIG. 5A and FIG. 5B as an outboard propulsion drive for a boat.

FIG. 7B shows a pump as in FIG. 5A and FIG. 5B mounted on an out board motor 39 for rotation and the outboard mounted to a boat stem 41. The handle for steering and throttle is 40. The pump has an intake 42 facing forward in the boat and a discharge 43 facing aft.

FIG. 8A is a front sectional view of a multiple purpose pump which has a vane and rotor configuration similar to FIG. 6A and FIG. 6B, but FIG. 8A and FIG. 8B show multiple discharge ports which are located at different axial distances from the axis of revolution determines the fluid velocity and head pressure, the three ports shown represent different fluid pressure at the same rotational speed of the rotor.

Fluid enters at intake port 10 and is discharged in one of the three ports 30, 31, or 32, in which the fluid exits the fluid chamber 15 tangentially, but with also an axial component. The ducts leading from ports are equipped with valves, such as ball valves, as shown in FIG. 8C, 8D, 8E, 8F, 8G, 8H.

FIG. 8B is a sectional side view of FIG. 8A.

FIG. 8C illustrates the operation of the pump in the high pressure, low flow mode. Fluid enters chamber 10 with valves 37 open and is pumped out through discharge port 32 with the valves 37 on ports 30 and 31 closed. Because of the port location and the tapering of the pumping chamber, the pressure will be high since the tangential velocity is at a maximum at this point.

FIG. 8D shows valves 37 at 10 and 31 open and closed at 30 and 32. In this position, the flow is increased over FIG. 8C but the pressure is decreased due to the fluid velocity being determined by the rotor diameter at port 31. The flow is increased due to longer ports and a wider fluid chamber between vanes. So that this represents a medium pressure, medium flow. The shaded portion represents a fluid flywheel bounded by an isobar.

FIG. 8E shows the valves 37 at intake 10 open, the valves 37 at 32 and 31 are closed such that fluid enters at 10 and discharged through port 30 at a higher flow rate, but with less pressure.

By having ports 30 and 31, the efficiency of the pump is increased if the pressure requirement is low and the pump is discharging at 32, there is no point to the high velocity since it consumes power as power consumption is proportional to flow times pressure, so while the pump described in FIG. 1A is quite efficient at higher head pressures, it is not efficient at lower head pressures, whereas the pump shown in 8A and 8B is efficient over a range of flow rates and head pressures and gives the user some very good options. In FIG. 8E, the shades areas show the revolving liquid flywheel has expanded and the pump doesn't operate in the shaded areas.

FIG. 8F and FIG. 8G show some interesting features of priming. If the pump is filled and the fluid circuit is as shown in FIG. 8F with valves 37 open at discharge ports 30 and 31 and closed at intake 37 at 10 and discharge valves 37 and 32, and the pump in a loop such that port 30 has changed from a discharge to has changed from a discharge to an intake. Then if the two valves 37 are cracked at intake 10 and discharge 32, the pump can prime and once primed, the choice of valves to close can be made.

FIG. 8H shows the pump operating partly as a centrifuge in order to separate fluids of different densities or denser solids from the fluid, such as pumping dirty fuel and having the dirty part discharged through a bleed valves 37 at discharge port 32, and the clean fuel being discharged through discharge port 31.

The shape of the pumping chamber pumping chamber housing is such that the centrifugal force which is developed within the fluid passages 15 between vanes 7 as shown in will cause more dense matter to accumulate along the boundary between vanes 7 and housing member 1 at 33 in FIG. 8B, and then is carried on to discharge port 32, where it may be bled off.

FIG. 9 shows a front view of a pump similar to that of FIG. 1A, except that there are two discharge ports, the discharge port 32 being at the isobar of highest pressure, and the port 31 being located on an isobar of less pressure, and the discharge port 31 is fitted with a value 37 to regulate flow.

FIG. 9B is a side view of FIG. 9A. A contaminated fluid, such as petroleum and water with rust, is drawn in through the inlet fitting 8 where it begins to acquire spin in the direction of rotation of rotor 3. The rotor and vanes are angled more than those shown in FIG. 1A and FIG. 1B and that is to begin the fluid separation of petroleum and the contaminants on the inclined surface shown at 33, such that when acquiring angular velocity, the more dense particles and fluids migrate to the axially outer surface 33. As the rotation continues, the denser elements arrive at the highest pressure isobar, at 25, where they continue by momentum into discharge port 32 and to flow restricting valve 37 shown in FIG. 9A. Depending on the ratio of contaminants to clean petroleum will determine the opening in the valve. If the valve is closed, the contaminants will simply accumulate in port 32 up to valve 37 as a sump. If valve 37 is opened, some clean fuel will pass through valve 37, and the remainder will be pumped through port 31.

Figure 9D:
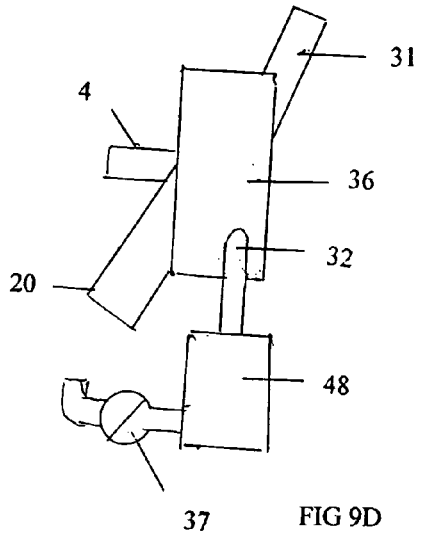

FIG. 9D shows 9B opened and the pump 36, discharges clean petroleum through port 31 and the contaminated fluid through 32. I have interposed 48, a settling tank between 32 and 37 which when valve 37 is closed can be a sump and when open 48 is a settling tank and filter, so that the filtered fuel may be returned to the intake source at 20 if desired.

FIG. 9C is a variation of FIG. 9B which shows a tangential intake means similar to that shown in FIG. 5A, with the objective that not only are particles within the fluid being separated by density, but the pump supplies a motor force by jet action such as in FIG. 7B.

FIG. 10 is a plan view of one use of the pump in FIG. 9C, as a gold dredge, which operates similar to a pool sweep. In FIG. 10, the pump 36 is mounted on carriage frame 43 having wheels 46 which allow the carriage to roll on the sea floor. Also mounted on the carriage is a hydraulic drive motor 44, which is coupled to pump 36 and also the drive shaft has an agitator rod 47 fixed to the shaft to strike and disturb the sand sea floor. The carriage is tethered to a barge 49 anchored by anchor 50. The rotation of the shaft 4 and the bar 47 causes sand to be thrown upward where it is sucked into the water intake of pump 36 at intake duct 42. The water and sand passes through pump 36 and the water and the less dense sand particles are discharged through discharge 31 and the more dense flour gold is collected in discharge hose 52 which terminates in Barge 49, and at the same time the carriage is moved forward in an arc in the direction of the arrow by the jet action of pump 36.

Conclusions, Ramifications, and Scope

Accordingly, the reader will see that by some relatively simple, but logical, changes to the basic structure of centrifugal pumps, the mode of operation of the pump as well as performance is dramatically changed. It is a change from an open unfocused divergent system to a focused system, which by the concept of containment becomes positive displacement.

This patent application describes a positive displacement tangential kinetic pump with very high power density.

It also describes a pump in which higher head pressures are available without excessive capacity and the ability to meter out flow like other positive displacement pumps.

It describes a pump, which is suitable to be used as a propulsion device.

It describes a pump which can separate a mixture of fluids of different densities, and which can remove solid and more dense particles while pumping the cleaned fluid It describes a pump, which can be used to simultaneously provide a motive power and separate out dense particles such as gold.

It describes a pump, which has the features, as aforementioned, and can also be simply changed in mode from a high-pressure low flow device to a device with low-pressure high flow, simply by opening or closing valves.

It describes a motor, which has the basic operation of the pump, except that the rotor takes energy from the fluid rather than delivering it, and such a motor being unusual in having a very high specific speed and as such is useful for hydroelectric power production.

So the scope of the invention is broadly described from a high power kinetic pump, to a high pressure pump, to a propulsion pump, to a centrifuge pump, to a general pump incorporating high flow and low pressure and thus being very efficient in terms of the drive motor, to a hydro motor, to a marine drive, to a gold dredge. This has been accomplished through simple but rational changes and the use of the principle of pressure stratification or isobars, within the pumping chamber in order to accomplish the objectives.

I claim:

1. A rotary kinetic pump which operates on principles on inertia and momentum and said pump having rotating chambers which are filled with fluid by NPSH driven by atmospheric pressure, with the fluid gaining rotational energy within any enclosed chamber through force being transmitted to the fluid by a curved housing wall rather than by a rotor blade, and the enclosed fluid being allowed to exit through one or more tangentially orientated rotary discharge ports; and with the structure of said rotary kinetic pump consisting of: a rotor having a radially inner surface and a radially outer surface, with at least one communicating passage, and with the radially inner surface forming an intake plenum, and the radially outer surface and an end surface rotating in close proximity to a cavity in a stator housing member, and at the juncture of the radially outer surface of said rotor, at least one tangential discharge port, for a short angular sector of rotation, passing through the stator housing member wall so that fluid is discharged sinusoidally and intermittently as the rotor passage passes the discharge port, and outside of the angular sector of rotation of the discharge port during rotation, the passage is closed by the close proximity contact with the inner cavity wall of the housing at least momentarily, such that fluid is contained within the rotor passage and is not moving with respect to said rotor passage, so that when said rotor passage passes said tangential discharge port, the fluid in the radially outer portion of said rotor passage is ejected by momentum, and leaves a vacuum in the radially inner portion of said rotor passage, such that fluid enters the radially inner fluid passage by NPSH, and the fluid is only drawn in when the passage is open to said tangential discharge port, so that intake only takes place for a limited angle of rotation for said fluid passage, and when fluid is passing through an extended passage which includes the rotor passage plus discharge port, the cross sectional area at the radially inner passage entrance is substantially larger than any downstream area, such that the higher velocity discharge fluid capacity does not exceed the intake capacity, and that the intake plenum has at least one fluid intake means passing through the stator housing wall in which fluid is aimed toward the angular sector of intake to any open rotor passage, such that fluid, driven by NPSH at that angular sector enters the fluid passage in said rotor in a direct manner in which little force exists between the entering fluid and the rotor passage walls.

2. A rotary kinetic pump as in claim 1, which operates on principles of inertia and momentum and by conservation of angular momentum, and with the inertial pump having rotating chambers in which are filled with fluid by NPSH driven by atmospheric pressure, and with the fluid gaining rotational energy within the enclosed chamber through force being transmitted to the fluid by a curved housing wall, and the enclosed fluid being allowed to exit through one or more tangentially orientated rotary discharge ports; with the structure of said rotary kinetic pump consisting of: a conical rotor hub with shaft and fixed vanes protruding from the convex surface of said conical hub and rotating in close proximity within an inner concave cavity of a housing and said housing also having a portion of said cavity which is not in close proximity, but which is located near the axis of revolution and is an intake plenum, which has one or more intake ports passing through said cavity wall to communicate with said rotor which are so aligned that intake fluid enters said intake plenum from a side wall of said housing cavity wall at an oblique angle and not passing through the axis of revolution, but instead passes at the conic angle of the rotor with the axis, near the axis, such that each intake stream travels in a straight line, entering chambers formed between adjacent vanes tangentially, and such that the intake fluid is moving in essentially the same direction as the inner vane tips, and at essentially the same velocity, and the fluid enters and fills said chambers by NPSH, and said chambers, when filled, and contained being bounded by adjacent vanes, the rotor hub, and the inner surface said housing cavity, and also bounded on the radially inner surface by an isobar of equal pressure, such that the fluid is contained and rotating, and that the fluid gains energy by being deflected by the arcuate inner housing cavity wall, such that a pressure gradient is formed with the enclosed fluid, and as said enclosed fluid chamber passes any radially outer tangential discharge port through said housing cavity wall, said tangential discharge being oriented in the direction of rotation, the contained fluid is allowed to discharge by momentum creating a vacuum radially inward in said rotor chamber, causing it to fill by NPSH, and while discharging, said rotor chamber becomes a fluid passage, intermittently and sinusoidally opening and closing and when open, said fluid passage then becomes an extended passage, being the passage through the rotor and plus also being bounded by said inner cavity wall of said housing as well as the tangential discharge duct, such that the extended passage is a converging geometry in a radially outward direction with the radially inner fluid entrance being larger that the fluid discharge of such a ratio that the passage allows as much fluid in as out, such that fluid passes through the pump with little interaction with the vanes, and being positive displacement since fluid is contained, then displaced; and such that only the contained fluid that is being discharged is near the radially outer portion of said rotor passages, such that fluid is discharged with a velocity approximately equal to the radially outer rotor tip velocity, and thus higher head can be reached, and it being desirable to have more than one discharge port because radial load is reduced.

3. A pump as in claim 1, having at least one intake duct which is not axial and at least one tangential discharge port, and at the intake, a volute is made in the concave, conical housing wall in order to keep the flow entering said rotor passages directly and tangentially.

4. A pump as in claim 1 that is engine driven in a boat as a means of propulsion with two intake ducts through the bottom of a vessel hull, and the intake fluid going toward the stern of the vessel, and the pump having two intake ports and at least two tangential discharge ports with the high momentum discharge fluid directed back from the stem of the vessel to provide a marine jet pump which propels the vessel by momentum change, and the propulsion jet streams having the ability to steer that vessel by opening or closing valves in the two jet streams.

5. A pump as in claim 1 that is engine driven similar to an outboard motor, with the tangential intake duct aiming forward below the water line of a small vessel, and the tangential discharge duct aimed to the stern of the vessel, and with the pump being able to be turned in an arc to be able to steer the vessel, thus becoming an outboard jet pump.

6. A fluid motor with a tangential intake geometry similar to the pump intake in claim 2 but with 2 or more inlet ducts, and a conical rotor with shaft fitted for rotation, the convex rotor surface fitted with arcuate spiraling vanes fixed to the convex surface and rotating in close proximity to a concave housing surface, and said spiraling vanes arching opposite to the direction of rotation and are more in a radial direction at the radially inner intersection with the incoming fluid stream, but near to tangential at the radially outer rotor diameter similar to centrifugal vane pump design, and so that high velocity fluid impinges on the following side of said vanes and the housing member having an open discharge extending 360 degrees of rotation, such that the fluid exits from the chambers between vanes arched back such that the fluid strikes the vanes at a near to normal direction throughout the sector of impact from the high velocity fluid, and such that the fluid entering with high momentum, delivers energy to rotor by impact, causing the rotor to rotate and slowing the fluid to near to being stopped, the rotor gaining nearly all the energy from the fluid; and with the motor starting from rest as a jet device with the fluid stream exiting the rotor tangentially with force, but during rotation under load, the exit fluid loses nearly all kinetic energy, and the rotor gains the energy.

7. A rotary kinetic pump which operates on principles of in inertia, in particular, by the conservation of angular momentum, having rotating chambers which are filled with fluid by NPSH driven by atmospheric pressure, with the fluid gaining rotation energy within the enclosed chamber through force being transmitted to the fluid by a curved housing wall rather than by being struck by a rotor blade, and the enclosed fluid being allowed to exit the chamber through any tangentially orientated rotary discharge port; and with the structure of said rotary of said rotary kinetic pump consisting of a rotor hub with shaft having an radially projecting conical protrusion and being more cylindrical on the radially end and outer surfaces, with vanes protruding from said radially outer and end rotor surfaces, and said vanes being tangent to the direction of rotation on the radially inner vane tips, but more radial in orientation at the radially outer vane tips, and each vane being angled back from direction of rotation from a sharp radially tangential inner tip to a more radially orientated outer tip at the radially outer diameter, and having adjacent vanes forming a rotating chamber the which gains rotational energy and a pressure gradient within said chamber, and which is bounded by the rotor, adjacent rotor vanes, a radially inner surface of revolution being a surface of equal pressure isobar, and a radially outer surface of revolution also a surface of equal pressure, and also a stator housing element consisting of a cavity in which said rotor rotates with the rotating vanes in close proximity to said cavity surface except at the radially inner portion of said cavity where an intake plenum cavity is formed which has an axial intake duct through said stator housing which is an axial diverging shape toward the intake plenum, and said stator cavity also having one or more tangential discharge ports passing through said radially outer stator housing wall in the direction of rotation to allow the rotating contained fluid in any rotor chamber to pass by momentum tangentially through any of said tangential discharge ports, thus completing the basic structure, but with the function of the pump being such that when any fluid contained any rotor chamber passes any tangential discharge port, the radially outer fluid exits tangentially from the radially outer boundary of said chamber, and is ejected at approximately the tip velocity of the radially outer vane rotor tip, and this creates a vacuum zone at that radial inner boundary of said chamber, causing fluid to be drawn into the chamber which has become an extended fluid passage which opens intermittently and sinusoidally as fluid being discharged and entering, and the said extended passage being the rotor chamber shape, plus a boundary on the inner cavity surface of the stator housing, which changes sinusoidally in length, plus the shape of the tangential discharge port; and that the shape of said extended fluid passage is essential to the invention, that the passage must be much larger in cross section at the radially inner opening into the fluid passage, and the passage must be converging in cross sectional area with increased radial distance; with the radially inner opening much larger in cross-sectional area than the discharge port; such that the differential fluid velocities at inlet and outlet are taken in account so that the pump is not trying have the discharge flow exceed the intake flow and thus causing cavitation, and also because the passages pump fluid intermittently and sinusoidally, with still another essential and critical design factor being how the fluid enters the rotor chambers, which is as follows; the fluid enters by an axial intake that becomes divergent due to a divergent chamber entry as well as fluid being forced radially outward by the conical rotor hub, such that the fluid enters the intake plenum with a radial flow component, but since this design has each rotor passage opening intermittently and sinusoidally at the same angular sector, the fluid within the intake plenum is caused to rotate as a vortex by the inner vane tips, since the fluid cannot enter the rotor chambers continuously, this causes the fluid to enter tangentially into the rotor chambers rather than radially, and since it enters tangentially into the chambers that are angled away from the direction of rotor motion, and since the inner vane tip is sharp and intersects the intake fluid at the radially outer plenum surface tangentially, there is very little contact or force with the vane surface, either on the leading edge of the following edge, since at that juncture, the incoming fluid is moving both in the same direction and with near to the same velocity as the inner vane tip, such that fluid enters the angled back rotor chamber by only being forced by atmospheric pressure acting against the rotating suction caused by discharging fluid in the chamber, and this allows fluid to enter each larger fluid chamber intermittently and sinusoidally with much less velocity between the fluid and the vanes, and with almost no force, having the result that there is little fluid shear, allowing the pumping of shear sensitive fluids, and also there is less wear due to less velocity, and also there is no source of cavitation or vane tip erosion and since generally only four or less vanes, the fluid passages are large and can accommodate debris without clogging and the sharp inner vanes tips can chop up incoming debris; and the pump being more robust and simpler geometric design, and being more powerful for size, results in advantages both in cost and performance; thus describing a pump that allows many new options and variations.

8. A pump as in claim 7 in which the inlet duct has spiral guides to direct the intake fluid into the rotor passages.

9. A pump as in claim 7 in which the rotor has a center cone, which moves the incoming fluid outward radially and the cone also has small radially attached vanes, which impart rotary motion to the inlet fluid within the intake plenum.

10. A pump as in claim 7 in which said housing cylindrical chamber cavity has at least two discharge ports which are supplied with valves in order to open or close, and each discharge port being located on a different radius from the axis of rotation and each discharge port corresponding to a different pressure isobar, such that the pressure output of the pump may be chosen by choosing different discharge ports.

11. A pump as in claim 10 in which the shape of said chamber cavity is a conic frustum with the base being perpendicular to axis of rotation, such that the axial width of the chamber decreases with increasing radius from the axis and the ports are longer in sector opening at smaller radial distance from the axis of rotation which allows greater flow rates at the longer port openings.

12. A pump as in claim 7 in which said intake means is to allow slurries or sludge, or other semi-liquid fluids to enter said pump, and having additional intake ports into the primary intake duct with valves joining said slurry intake in said pump for water entry.

13. A fluid pump as in claim 7 in which the pump is to provide the separation of dense particles entrained within the fluid, such that the pump has two discharge ports, with the port at a further radial distance from the axis of rotation having a bleed control valve and being used for particle separation, and the remaining port can be used for thrust momentum and to remove less dense entrained material, thereby.

* * * * *